US007036662B2

(12) United States Patent
Schütz

(10) Patent No.: US 7,036,662 B2
(45) Date of Patent: May 2, 2006

(54) TRANSPORT AND STORAGE CONTAINER FOR LIQUIDS

(75) Inventor: Udo Schütz, Selters/Westerwald (DE)

(73) Assignee: Protechna S.A., Frobourg (CH)

( * ) Notice: Subject to any disclaimer, the term of this patent is extended or adjusted under 35 U.S.C. 154(b) by 253 days.

(21) Appl. No.: 10/760,113

(22) Filed: Jan. 16, 2004

(65) Prior Publication Data

US 2004/0164082 A1 Aug. 26, 2004

(30) Foreign Application Priority Data

Jan. 17, 2003 (DE) ..... 103 01 517

(51) Int. Cl.
*B65D 19/00* (2006.01)

(52) U.S. Cl. ..... 206/386; 220/1.5; 220/495.01; 220/23.87; 220/630

(58) Field of Classification Search ..... 206/386; 220/1.5, 23.87, 630, 636, 611, 285, 459.01
See application file for complete search history.

(56) References Cited

U.S. PATENT DOCUMENTS 4,909,387 A * 3/1990 Schutz ..... 206/386
5,645,185 A * 7/1997 Cassina ..... 220/1.5
5,655,679 A * 8/1997 Schutz ..... 220/1.6
5,678,688 A * 10/1997 Schutz ..... 206/386
5,924,589 A * 7/1999 Gordon ..... 220/23.91
6,290,082 B1 * 9/2001 Van Giezen et al. ..... 220/23.91

* cited by examiner

*Primary Examiner*—Jila M. Mohandesi
(74) *Attorney, Agent, or Firm*—Friedrich Kueffner

(57) ABSTRACT

A transport and storage container for liquids has a pallet bottom frame, a latticework enclosure connected to the bottom frame, and an inner container received in the enclosure. The vertical rods of the latticework enclosure are connected to upper and lower peripheral profiled edge sections. The vertical rods are hollow and have flattened upper ends shaped to a wave profile with welding projections. The upper profiled edge section is a hollow profiled section formed to a double bar that extends peripherally and transversely to the vertical rods and is shaped to have inner and outer wave profiles engaging one another. The outer wave profile has grooves, and the inner wave profile forms welding projections. The upper ends of the vertical rods and the double bar are connected by projection welding. The upper profiled edge section has a flat upper rim for supporting legs of a container stacked on top.

10 Claims, 6 Drawing Sheets

TRANSPORT AND STORAGE CONTAINER FOR LIQUIDS

BACKGROUND OF THE INVENTION

1. Field of the Invention

The invention relates to a transport and storage container for liquids. The container comprises a pallet-like bottom frame for an exchangeable inner container of plastic material having four sidewalls, a bottom, and a top. A closable filling socket is formed as a part of the top. A tapping socket is formed as part of a lower portion of one of the sidewalls and is provided with a tap fixture. A latticework enclosure having horizontal and vertical rods of metal is provided for receiving the inner container, wherein the ends of the vertical rods are welded to lower and upper peripheral profiled edge sections.

2. Description of the Related Art

When lateral sliding of a transport and storage container for liquids of the aforementioned kind, disclosed in European patent 0 370 307 B1, on a container of the same kind positioned underneath occurs during transport or stacking, there is the risk that the corner and center legs of the upper container slide inwardly off the upper profiled edge section, formed as a tube, of the latticework enclosure of the lower container. This has the results that the upper area of the latticework enclosure of the lower container is widened under the weight of the upper container filled with liquid so that the screw connections of the top bars extending diagonally across the top of the inner plastic container to the upper profiled edge section become detached, and the inner container as well as the welded connections of the upper ends of the vertical rods to the upper profiled edge section of the latticework enclosure become damaged. Moreover, there is the possibility that during transport of the stacked containers, as a result of external impact and striking loads, the welding connections of the vertical rods with the upper profiled edge section of the latticework enclosure will fail and the profiled edge section will become detached, partially or completely, from the vertical rods of the latticework enclosure so that in this way transport damage is caused on the containers.

SUMMARY OF THE INVENTION

It is an object of the present invention to improve the construction of latticework enclosure of the transport and storage container for liquids of the aforementioned kind with respect to an increased stacking and transport safety.

In accordance with the present invention, this is achieved in that:

the upper flattened ends of the vertical rods of the latticework enclosure that are formed as hollow profiled sections are shaped to a wave profile having at least two welding projections;

a double bar is formed on the upper profiled edge section of the latticework enclosure that is embodied as a hollow profiled section, wherein the double bar extends peripherally and transversely to the vertical rods;

wherein the double bar is shaped to have an inner wave profile and an outer wave profile, wherein the two wave profiles engage one another;

wherein the outer wave profile has formed grooves and wherein the inner wave profile forms at least two peripheral welding projection rims;

wherein the upper ends of the vertical rods and the double bar of the upper profiled edge section of the latticework enclosure are connected to form a cruciform joint by projection welding; and wherein the upper profiled edge section has a flat upper peripheral rim for supporting corner legs and center legs of a palette-shaped bottom frame of a container stacked on top.

The transport and storage container for liquids according to the invention has the following advantages.

The flat upper peripheral rim of the upper profiled edge section of the latticework enclosure (jacket) of the transport and storage container ensures a save support action for a container stacked on top of a container positioned underneath by means of its corner and center legs. The wave profile formed in the double bar of the upper profiled edge section of the latticework enclosure (jacket), having preferably three peripheral welding projections, and the wave profile of the flattened (compressed to a flat shape) upper ends, having at least two welding projections, of the vertical rods of the latticework enclosure that are embodied as hollow profiled sections ensures an optimal projection welding connection of the vertical rods and the upper profiled edge section of the latticework enclosure with cruciform joints, wherein grooves that are formed in the outer wave profile of the double bar of the upper edge profile of the latticework enclosure, the double bar having an inner and an outer wave profile, enable an optimization of the pressing force of the welding electrodes. The support rim, which is springy to a limited extent and is oriented away from the double bar at a slant inwardly into the upper profiled edge section of the latticework enclosure and is supported with its inner rim on the upper end of the vertical rods, will contact, under the stacking load of a container stacked on top, across the entire width the upper ends of the vertical rods so that the welding connections at the cruciform joints of the vertical rods and of the horizontal upper profiled edge sections of the latticework enclosure are not loaded by the stacking load; the stacking load that acts suddenly onto a container in the bottom position during stacking is buffered and, in this way, damage of the latticework enclosure is prevented.

By connecting the flattened upper wave-shaped ends of the tubular vertical rods of the latticework enclosure to the pipe sections of the rods, by means of curved or arc-shaped portions that, under the stacking load of the container stacked on top, provide predetermined bending location that are elastic to a limited extent, the spring action of the upper profiled edge section of the latticework enclosure is further improved so that impact loads during transport, caused by a container stacked on top as a result of uneven road surfaces and hard suspension of the transport device as well as driving vibrations of the transport device, can be buffered. Finally, by receiving the upper ends of the vertical rods in a peripheral groove-shaped portion of the upper profiled edge section of the latticework enclosure, it is prevented that the rods will become detached from the profiled edge section when the welding connections of individual rods to the upper profiled edge section are destroyed as a result of overloads because of an excessive outer impact or striking load, for example, when the transport and storage container drops from a great height.

DESCRIPTION OF THE PREFERRED EMBODIMENTS

Figure 1:
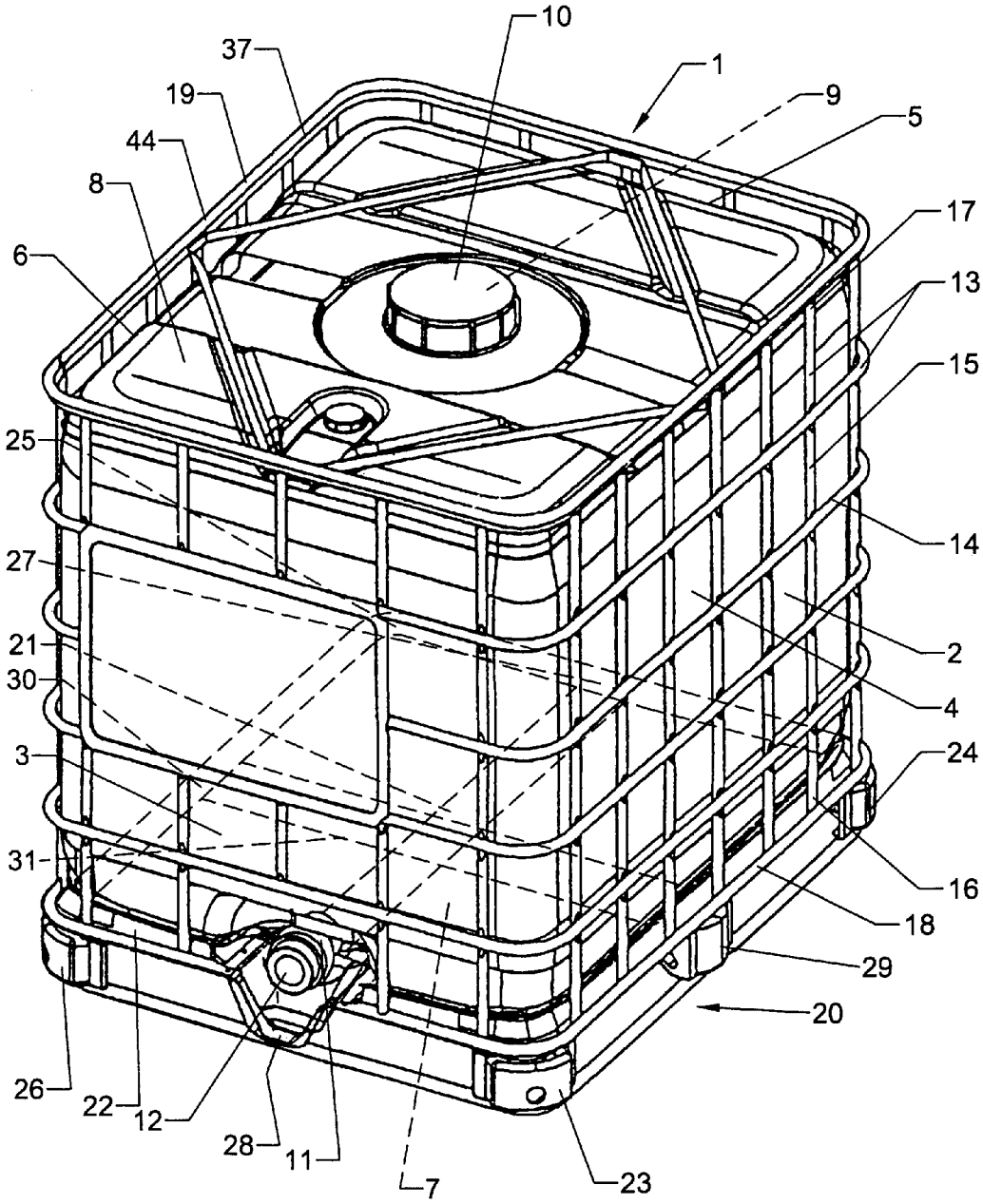
FIG. 1 shows a perspective illustration of a transport and storage container according to the invention.

The transport and storage container 1 for liquids that is used as a disposable or reusable container has as its main components an exchangeable square inner container 2 made of plastic material that is comprised of four sidewalls 3–6, a bottom 7, and a top 8. A filling socket 9 is formed as part of the top 8 and is provided with a lid 10. A tapping socket 11 is formed as part of a lower section of the sidewall 3 and is provided with a tapping fixture 12. Moreover, an outer latticework enclosure 13 of crossed horizontal and vertical rods 14, 15 of metal is provided for receiving the inner container 2, wherein the ends 16, 17 of the vertical rods 15 are welded to lower and upper peripheral profiled edge sections 18, 19 of the latticework enclosure 13. A pallet-shaped bottom frame 20 is provided also and has length and width dimensions complying with European standards.

The bottom 7 of the inner container 2 forming a drainage bottom is provided with a centrally arranged drainage groove 21 extending at a downward slant from the back wall 5 of the container to the drainage socket 11 in the front wall 3. The inner container 2 is positioned with its bottom 7 on the bottom 22 of the bottom frame 20 having a shape matching that of the bottom 7.

The bottom 22 of the bottom frame 20 is designed to be handled by means of forklifts, storage shelf operating devices and similar transport means. It is supported by four corner legs 23–26, a rearward center leg 27, a forward center leg 28 formed as a part of the bottom 22 and arranged underneath the drainage fixture 12 of the transport container 1, as well as two lateral central legs 29, 30 that are formed by the outer ends of a bridge-shaped reinforcement metal plate 31 for the bottom 22.

Figure 3:
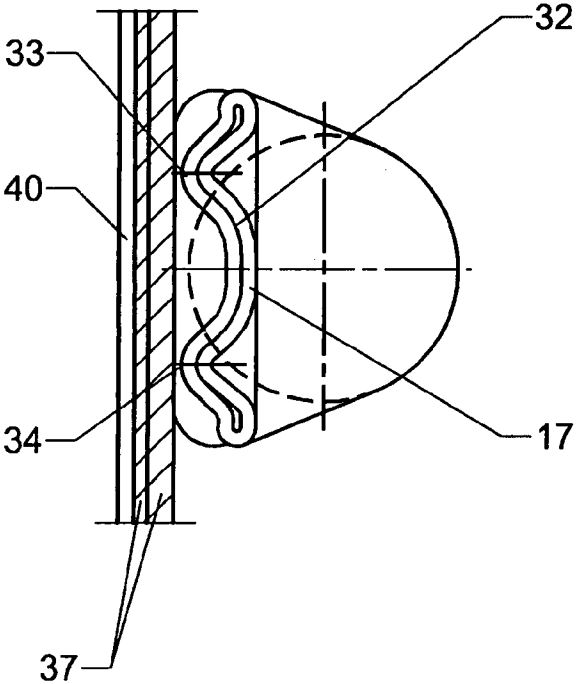
FIG. 3 is a cross-section of a cruciform welding connection of the upper profiled edge section of the latticework enclosure of the container to the upper end of a vertical rod of the latticework enclosure along the line III—III of FIG. 2 in an enlarged representation.

The flattened (pressed flat) upper ends 17 of the vertical tubular rods 15 of the latticework enclosure 13 are shaped to a wave profile 32 with two welding projections 33, 34 (FIG. 3).

The upper profiled edge section 19 of the latticework enclosure 13 is comprised of an open square profiled section 35 with rounded edges and a semi-tubular profile section 36. A double bar 37 is formed on the upper profiled edge section 19 and extends peripherally and transversely to the vertical rods 15. The double bar 37 is formed to have an inner and an outer wave profiles 38, 39. The two wave profiles 38, 39 mesh with one another. The outer wave profile 39 is provided with grooves 40. The inner wave profile 38 of the double bar 37 of the profiled edge section 19 forms three peripheral welding projection rims 41–43 (FIG. 2).

The upper ends 17 of the vertical rods 15 and the double bar 37 of the upper profiled edge section 19 of the latticework enclosure 13 of the transport and storage container 1 are welded to one another to form cruciform joints at six welding connections.

Figures 2, 4, 5:
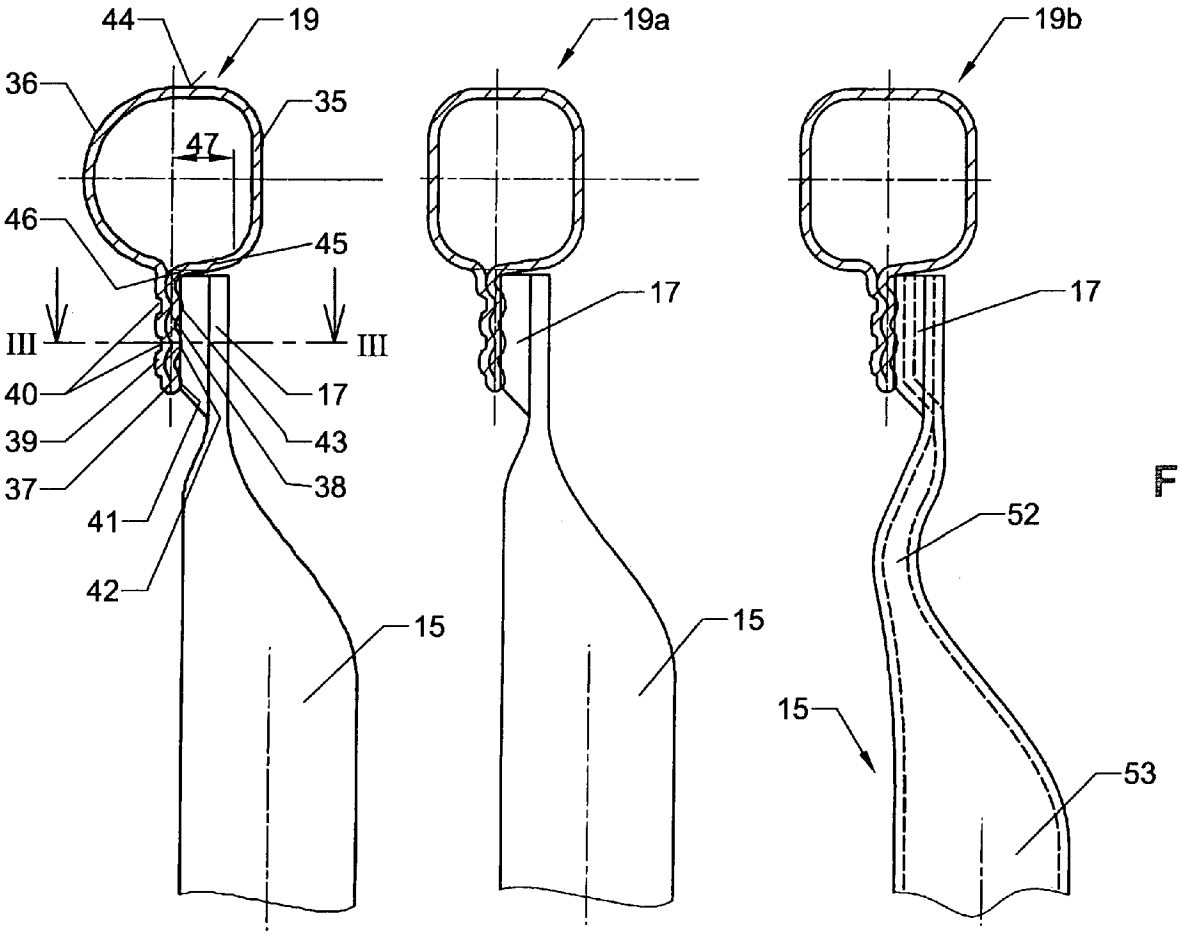
FIG. 2 is a cross-section of the upper profiled edge section of the latticework enclosure of the transport and storage container according to FIG. 1 in an enlarged representation.
FIG. 4 shows a cross-section of another embodiment of the upper profiled edge section of the latticework enclosure of the container.
FIG. 5 shows a cross-section of another embodiment of the upper profiled edge section of the latticework enclosure of the container.
Figure 11:
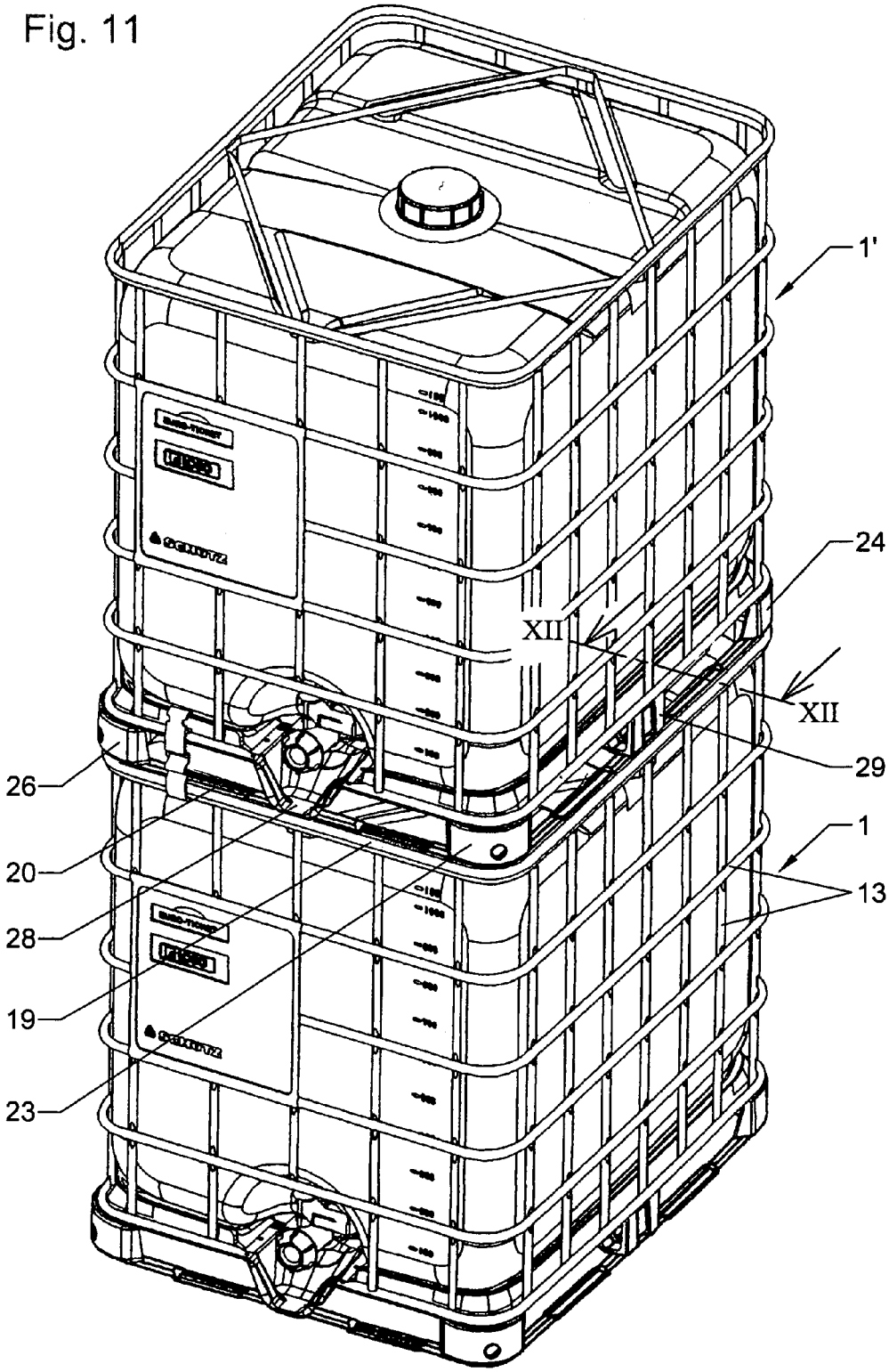
FIG. 11 is a perspective illustration of two stacked transport and storage containers.
Figure 12:
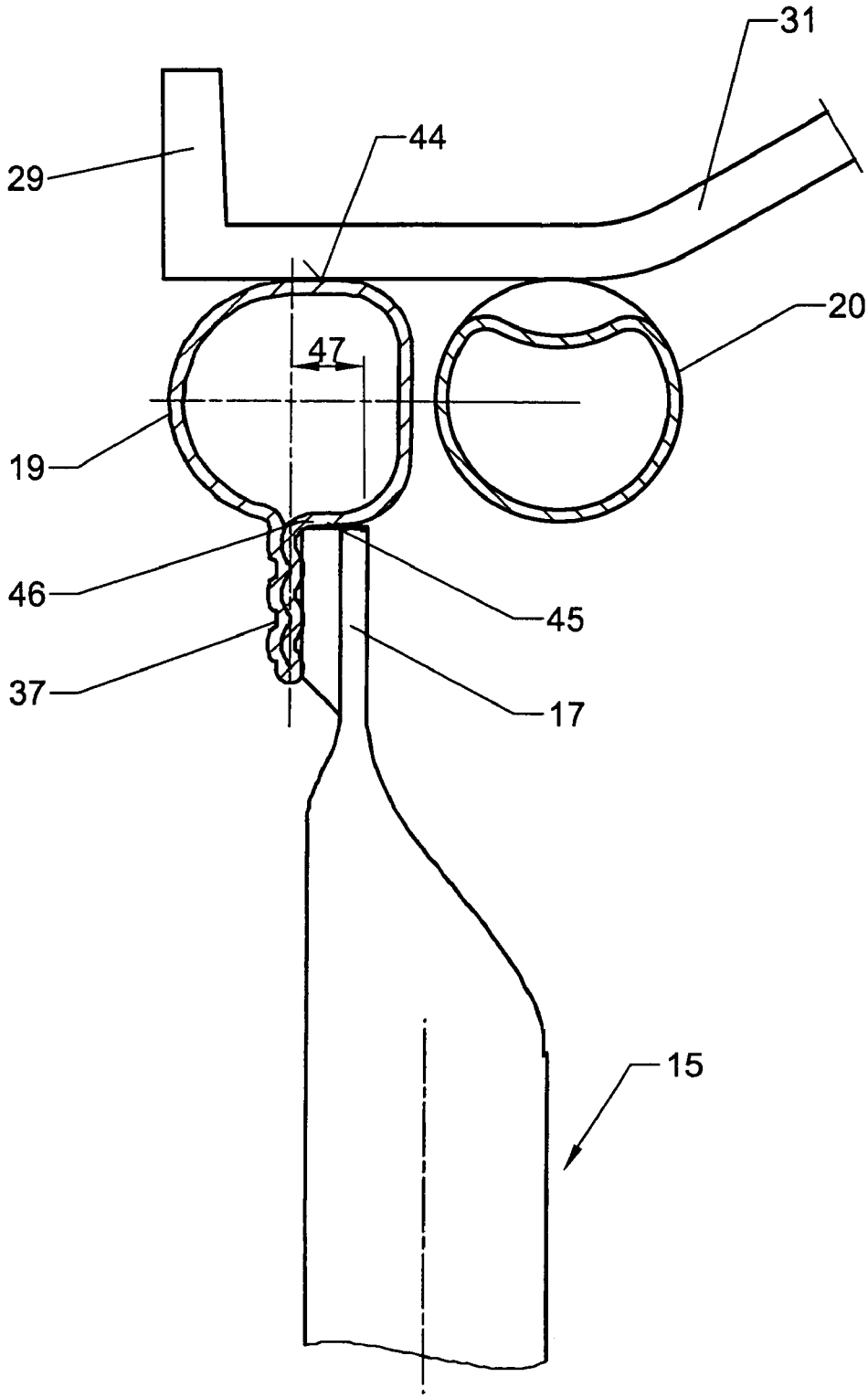
FIG. 12 is a schematic partial cross-section along line XII—XII of FIG. 11 in an enlarged representation.

The upper profiled edge section 19 of the latticework enclosure 13 has an upper flattened peripherally extending rim 44 for supporting the corner and center legs 23–30 of the pallet-shaped bottom frame 20 of a pallet container 1' stacked on top (FIGS. 2, 11, and 12).

The upper profiled edge section 19 of the latticework enclosure 13 has a support rim 45 that is springy to a limited extent and is oriented, beginning at the double bar 37, at a slant inwardly into the profiled edge section and is supported with the inner rim 46 on the upper ends 17 of the vertical rods 15. Under the stacking load of a container or several containers 1' stacked on top, the support rim 45 rests across approximately the entire width 47 on the upper ends 17 of the vertical rods 15.

FIGS. 4 to 10 show further embodiments 19*a*–19*g* of the upper profiled edge section of the latticework enclosure 13 of the transport and storage container 1.

The profiled edge section 19*a* according to FIG. 4 is a narrow square profiled section and the profiled edge section 19*b* according to FIG. 5 is a wide square profiled section. Both embodiments have rounded edges.

Figure 6:
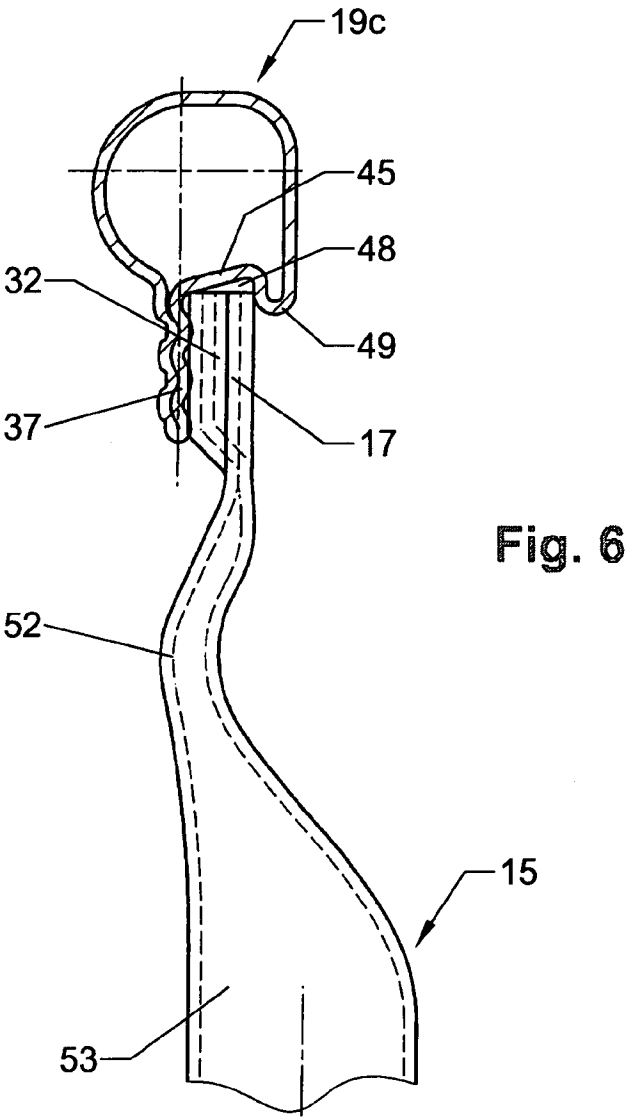
FIG. 6 shows a cross-section of another embodiment of the upper profiled edge section of the latticework enclosure of the container.

In the upper profiled edge section 19*c* of the latticework enclosure 13 illustrated in FIG. 6, the upper ends 17 of the vertical rods 15 are secured in a peripheral groove-shaped recess 48 of the profiled edge section; the recess 48 is formed by the double bar 37, the support rim 45 that is oriented inwardly into the profiled edge section and is springy to a limited extent, as well as a bead 49 formed on the rim 45 and oriented downwardly.

Figure 7:
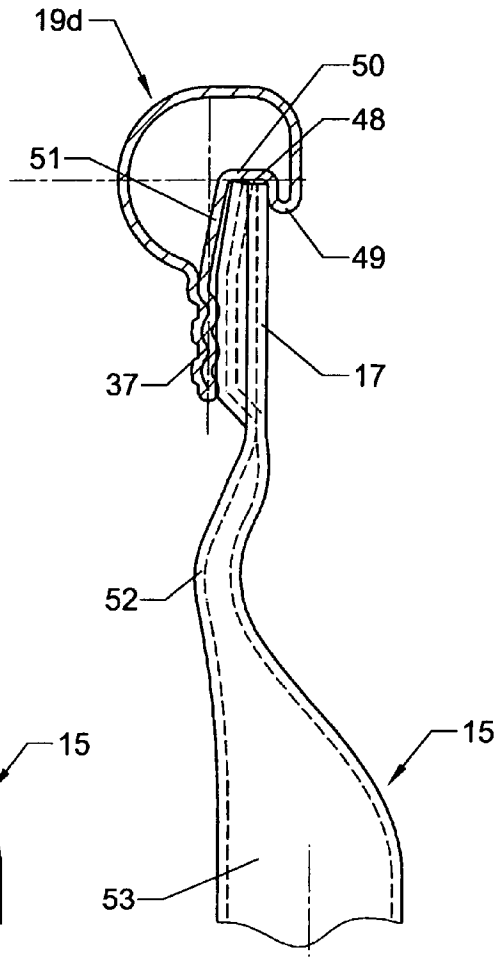
FIG. 7 shows a cross-section of another embodiment of the upper profiled edge section of the latticework enclosure of the container.
Figure 8:
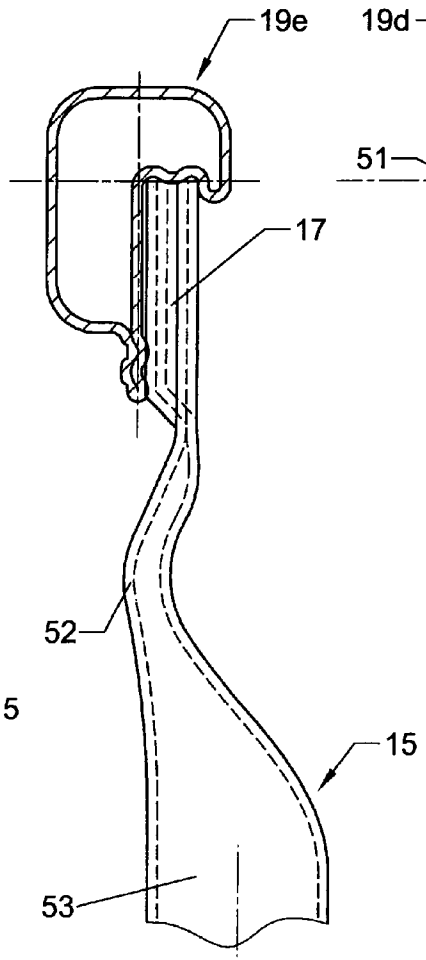
FIG. 8 shows a cross-section of another embodiment of the upper profiled edge section of the latticework enclosure of the container.
Figure 10:
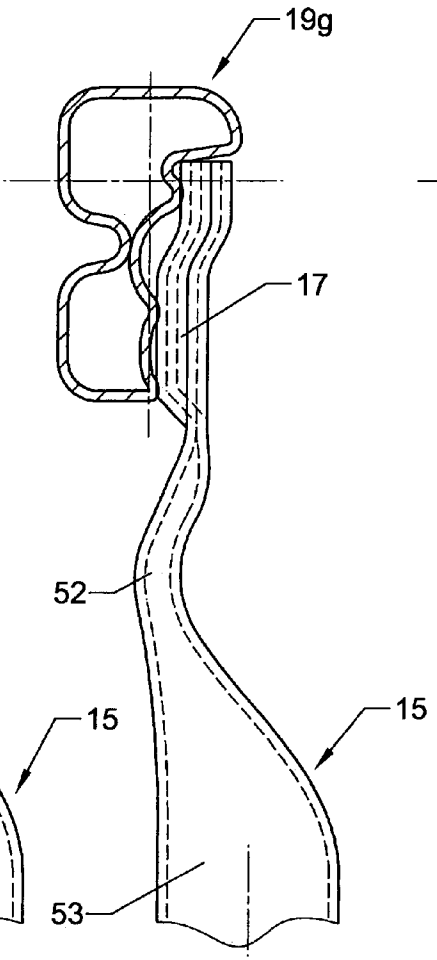
FIG. 10 shows a cross-section of another embodiment of the upper profiled edge section of the latticework enclosure of the container.
Figure 9:
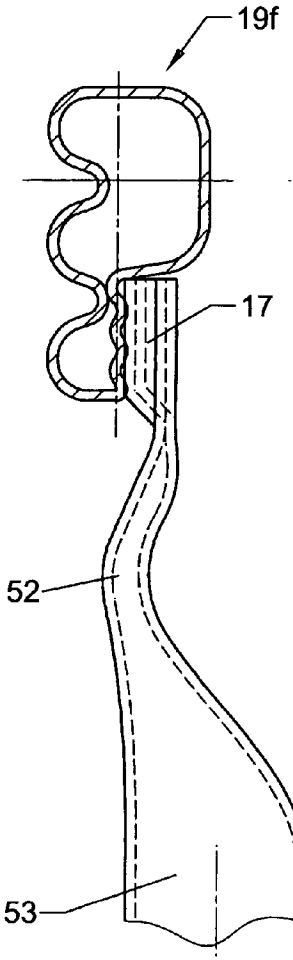
FIG. 9 shows a cross-section of another embodiment of the upper profiled edge section of the latticework enclosure of the container.

The upper profiled edge section 19*d* of the latticework enclosure 13 illustrated in FIG. 7 differs from the profiled section 19*c* according to FIG. 6 in that the profiled edge section 19*d* is supported by a straight support stay 50 formed at the bottom of the recess 48 on the upper ends 17 of the vertical rods 15, wherein the recess 48 of the profiled edge section 19*d* is formed by an inwardly displaced inclined wall section 51 adjoining the double bar 37, the support rim 50, and a bead 49 formed on the support stay 50 and oriented downwardly.

In the different upper profiled edge sections 19*b*–19*g* of the latticework enclosure 13 of the transport and storage container 1 illustrated in FIGS. 5 through 10, the flattened upper ends 17 of the vertical tubular rods 15 of the latticework enclosure 13 provided with a wave profile 32 are connected by means of arc-shaped or curved sections 52, which, under the stacking load of one or several stacked containers 1', provide bending locations that are elastic to a limited extent, to the straight pipe sections 53 of the rods 15, wherein the cross-section of the sections 52 have a continuous transition from a flat rod cross-section into a tubular round cross-section.

When stacking two transport and storage containers 1, 1', the upper container 1', respectively, is supported with the corner and center legs 23–30 of the bottom frame 20 safely on the upper wide rim 44 of the upper profiled edge section 19 of the latticework enclosure 13 of the lower container 1 (FIGS. 11 and 12).

While specific embodiments of the invention have been shown and described in detail to illustrate the inventive principles, it will be understood that the invention may be embodied otherwise without departing from such principles.

What is claimed is:

1. A transport and storage container for liquids comprising:

a pallet-shaped bottom frame;

a latticework enclosure connected to the bottom frame;

wherein the latticework enclosure has horizontal and vertical rods of metal and a lower peripheral profiled edge section and an upper peripheral profiled edge section, wherein the vertical rods have upper ends welded to the upper peripheral profiled edge section and lower ends welded to the lower peripheral profiled edge section;

an exchangeable inner container of plastic material having four sidewalls, a bottom, and a top, wherein a closable filling socket is formed as a part of the top and a tapping socket is formed as a part of a lower portion of one of the sidewalls and is provided with a tap fixture;

wherein the inner container is received in the latticework enclosure;

wherein the vertical rods are hollow profiled sections and the upper ends are flattened and shaped to a wave profile having at least two welding projections;

wherein the upper profiled edge section is a hollow profiled section and is formed to have a double bar, wherein the double bar extends peripherally and transversely to the vertical rods;

wherein the double bar is shaped to have an inner wave profile and an outer wave profile;

wherein the inner and outer wave profiles engage one another;

wherein the outer wave profile has formed grooves and wherein the inner wave profile forms at least two peripheral welding projection rims;

wherein the upper ends of the vertical rods and the double bar are connected by projection welding to form cruciform joints; and wherein the upper profiled edge section has a flat upper peripheral rim for supporting corner legs and center legs of a pallet-shaped bottom frame of a container stacked on top.

2. The transport and storage container according to claim 1, wherein the inner wave profile of the double bar has three of the peripheral welding projection rims.

3. The transport and storage container according to claim 1, wherein the upper profiled edge section has a support rim that is springy to a limited extent and is oriented, beginning at the double bar, at a slant inwardly into the upper profiled edge section and is supported with an inner rim on the upper ends of the vertical rods, wherein, under a stacking load of a container or several containers stacked on top, the support rim rests across approximately an entire width against the upper ends of the vertical rods.

4. The transport and storage container according to claim 3, wherein the upper profiled edge section has a peripheral groove-shaped recess and wherein the upper ends of the vertical rods are secured in the recess, wherein the recess is formed by the double bar, the support rim, and a bead formed on the support rim and extending downwardly.

5. The transport and storage container according to claim 1, wherein the upper profiled edge section has a peripheral groove-shaped recess and wherein the upper ends of the vertical rods are secured in the recess, wherein the recess has a bottom providing a straight support stay, and wherein the straight support stay rests against the upper ends of the vertical rods.

6. The transport and storage container according to claim 5, wherein the recess is formed by an inwardly displaced inclined or vertical wall section of the upper profiled edge section adjoining the double bar, the support stay, and a bead formed on the support stay and extending downwardly.

7. The transport and storage container according to claim 1, wherein the upper profiled edge section is a square profiled section having rounded edges.

8. The transport and storage container according to claim 1, wherein the upper profiled edge section comprises an open square profiled section having rounded edges and a semi-tubular profiled section connected to an open side of the open square profiled section.

9. The transport and storage container according to claim 1, wherein the vertical rods each have curved sections adjoining the upper ends, wherein the curved sections, under a stacking load of one or several stacked containers, provide bending locations that are elastic to a limited extent, wherein the curved sections connect the upper ends to straight pipe sections of the vertical rods.

10. The transport and storage container according to claim 9, wherein the curved sections have a cross-section providing a continuous transition from a flattened rod cross-section at the upper ends into a tubular round cross-section.

* * * * *